US007150374B1

(12) United States Patent
Camps

(10) Patent No.: US 7,150,374 B1
(45) Date of Patent: Dec. 19, 2006

(54) DEVICE FOR STORING AND TRANSPORTING UNIT LOADS

(75) Inventor: Werner Philomena Theophiel Camps, Antwerp (BE)

(73) Assignee: Conteyor Multibag Systems N.V., Merelbeke (BE)

( * ) Notice: Subject to any disclaimer, the term of this patent is extended or adjusted under 35 U.S.C. 154(b) by 0 days.

(21) Appl. No.: 09/937,475

(22) PCT Filed: Mar. 24, 2000

(86) PCT No.: PCT/EP00/02633

§ 371 (c)(1),
(2), (4) Date: Nov. 15, 2001

(87) PCT Pub. No.: WO00/58183

PCT Pub. Date: Oct. 5, 2000

(30) Foreign Application Priority Data

Mar. 27, 1999 (DE) ..... 199 14 027

(51) Int. Cl.
*B65D 30/10* (2006.01)
*B65D 33/02* (2006.01)

(52) U.S. Cl. ..... 220/9.1; 206/583

(58) Field of Classification Search ..... 211/45, 211/46, 126.1; 206/583, 805; 198/715; 220/9.1, 9.2, 9.3, 23.2, 507, 535; 29/67.2; 383/9, 22, 33; 229/67.2
See application file for complete search history.

(56) References Cited

U.S. PATENT DOCUMENTS 1,389,995 A * 9/1921 Schutt ..... 414/140.8
2,758,703 A * 8/1956 Hampf ..... 198/715
2,956,668 A * 10/1960 Fioravanti ..... 198/370.05
3,779,393 A * 12/1973 Grundell ..... 211/126.13
4,400,107 A * 8/1983 Pitts ..... 402/4
4,730,721 A * 3/1988 Demaiter et al. ..... 198/715
4,988,213 A * 1/1991 Mattle ..... 383/6
5,377,811 A * 1/1995 Tanaka ..... 198/418.6
5,457,944 A * 10/1995 Lipes ..... 53/572
6,164,440 A * 12/2000 Van Bree ..... 198/867.11

FOREIGN PATENT DOCUMENTS

| | | |
|---|---|---|
| DE | 41 38 507 | 5/1993 |
| DE | 195 49 166 | 7/1997 |
| DE | 199 03 297 | 1/2000 |

* cited by examiner

*Primary Examiner*—Nathan J. Newhouse
*Assistant Examiner*—Harry Grosso
(74) *Attorney, Agent, or Firm*—Michael L. Dunn

(57) ABSTRACT

The invention relates to a device for storing and transporting unit loads, especially articles whose dimensions are substantially larger in at least one or two directions perpendicular to each other than in the remaining third direction in space. Said articles are substantially accommodated in U-shaped pouches (4, 5) that consist of flexible sheet material and that are mounted in a rack or a frame. Said pouches (4, 5) are suspended in one or more points in the vicinity of their upper edge and are fixed at least in one additional point in the area of their lower edge or below said lower edge. The inventive device is characterized by a substantially improved ease of loading. The individual articles are securely held in the pouches (4, 5).

17 Claims, 5 Drawing Sheets

DEVICE FOR STORING AND TRANSPORTING UNIT LOADS

BACKGROUND OF THE INVENTION

The present invention concerns an apparatus for storing and transporting piece goods, in particular articles whose dimensions in at least one or two mutually perpendicular directions are clearly larger than in the remaining third direction in space, wherein the articles are received in substantially U-shaped pockets which are formed from a flexible web material and which are arranged in a support stand or frame, wherein the pockets are suspended at one or more points in the proximity of their upper edge.

Apparatuses of that kind have already long been known, for example from German patent applications Nos P 41 58 507 and 195 49 166.

In the known apparatuses, the U-shaped pockets are formed by a long web of material which is laid in a plurality of loops which are suspended for example on bars or rods which are arranged at a spacing in succession so that accordingly the web of material is laid transversely over a first bar, extends downwardly and then extends upwardly again in a U-shape, is then laid over the next bar, and so forth. The portions which are hung over the bars can be sewn off in that case so that they form closed loops, through which the carrier bars extend so that the web of material cannot slip on those bars in the longitudinal direction thereof and thus the U-shaped pockets are always of the same length or depth.

In addition those U-shaped pockets can also be formed in many other ways. Examples in that respect are shown in German patent application Nos 198 26 429.1, 198 57 575.0 and 199 03 297.1 which have not yet been published at the date of the present application. In particular the side walls of the pockets can be extended downwardly so that the result overall is an H-shape, or a plurality of U-shaped pockets which are arranged one above the other can be arranged in vertically mutually superposed relationship and connected together so that the above-mentioned U-shape or H-shape is repeated a number of times and the respective lower pockets are closed at their top side by the bottom of the pocket thereabove. The pockets can also be formed from individual webs of substantially the same shape and size, in each of which the lower end of a web adjacent to a first web is bent over in a J-shape and connected to the corresponding adjacent web, and so forth.

Corresponding apparatuses are used for example in the automobile industry for receiving bodywork parts and installation components such as for example door claddings, side doors, rear doors or tailgate doors and engine compartment hoods and also for many other forms of piece goods. The advantage of corresponding apparatuses is that they are relatively quick and easy to load and unload, that generally no additional packaging and damping material is required if the pockets themselves are formed from a sufficiently soft flexible material, which prevents damage to the delicate surfaces of articles to be transported, and that each article can be individually accommodated in a pocket and thus does not rub against and damage other articles. In that respect, a support stand or frame can simultaneously accommodate a plurality of corresponding pockets in a clearly reviewable arrangement and, depending on the respective configuration of the frame or support stand, each pocket is also individually accessible, more specifically either from an open top side or from at least one of the ends of the U-shaped pockets.

It will be appreciated that the frame or the support stand can also be such that it can be folded together to collapse it and, as the pockets comprise flexible web material, they can generally also be easily collapsed down together and folded so that in the empty condition the apparatus can also be transported in a very space-saving fashion.

Nonetheless problems still occur in use of corresponding apparatuses, and the aim of the present invention is to resolve such problems.

It can happen for example, in particular when the articles to be accommodated in the pockets are not of a flat level shape but are of somewhat more complicated shapes, as would be the case for example with engine hoods or the like of motor vehicles, that the pocket, after receiving the article or by virtue of receiving the article, suffers deformation somewhat and as a result adjacent pockets which are still empty also deform in such a way that the loading openings of the pockets become difficult to access, in other words for example an adjacent empty pocket is so deformed at a lateral loading opening thereof or also in its upper region that the insertion of a similar article or also another article into that empty pocket causes difficulties and is only possible by virtue of the loading opening being additionally held open with a hand. Conversely this can also interfere with removal of the individual articles from the pockets.

A further problem of the known apparatuses is also the fact that, when dealing with articles of an irregular shape, even if they are substantially two-dimensional and flat, nonetheless they cannot assume a clearly defined, stable position in the pockets because their lower edge does not afford sufficiently spaced-apart, well-defined contact support points so that such articles slip and tilt in the pockets and as a result a portion thereof possibly projects from one of the lateral loading openings so that there is the risk of damage during transportation of the apparatus with those articles because the articles are not accommodated in a completely protected condition in the pockets.

BRIEF DESCRIPTION OF THE INVENTION

In comparison with that state of the art, the object of the present invention is to provide an apparatus having the features set forth in the opening part of this specification, with which loading and unloading is facilitated and with which as far as possible the individual articles can also be more securely held in the pockets.

That object is attained in that the pockets additionally have at least one fixing in the region of their lower edge or below said lower edge.

By virtue of the fact that the pockets have at least one fixing in the proximity of their lower edge, the side walls of those pockets which in cross-section define the two limbs of the U-shape can be stressed or tensioned to a greater or lesser degree and are thus also held in shape and at a defined spacing, which does not exclude the articles received in the pockets nonetheless urging the side walls outwardly laterally in one region or the other, as those walls are formed from flexible web material. It is however possible to provide by virtue of that prestressing effect that at least the lateral loading openings retain a well-defined shape and minimum size so that access to the articles accommodated in the pockets and conversely loading the pockets with the articles can be implemented without the loading opening additionally being held open.

In this respect, the fixing can be arranged in such a way that the downwardly directed stressing or tensioning of the side walls substantially results in a V-shape in respect of the pocket, but it is also possible for fixing points to be arranged on both sides of the pockets, that is to say on a respective limb of the U-shape or a prolongation portion thereof, in such a way that the U-shape is substantially retained.

DETAILED DESCRIPTION OF THE INVENTION

Desirably the fixing is disposed in the proximity of a lateral loading opening of the pockets and at the lower edge thereof or beneath the lower edge because the influence of the tensioning force on the shape of the loading opening is at its greatest. It will be appreciated that it is also possible to provide a plurality of fixing points which are distributed over the length of the pocket, in particular also at the opposite end, in order better to hold the pocket generally in shape. In addition loading can also be implemented from both sides of the pocket so that in this case fixing at both ends of the pocket in the lower region thereof also appears desirable.

A particularly preferred embodiment of the invention is one in which the fixing is provided in such a way that it creates a defined stressing or tensioning force. In accordance with a first alternative configuration, that can be effected by that tensioning force being produced by a weight which is suspended at the lower pocket ends.

In specific terms, that can be achieved for example if the limbs of the U-shape of the individual pockets are provided with eyes in the lower region in the proximity of the loading opening, or if corresponding prolongation portions of those lateral limbs of the U-shape to constitute limbs of an H-shape are provided with eyes, in which case a bar can be pushed through a row of pockets which are suitably arranged in side-by-side relationship, through all the eyes which are in alignment with each other, the weight of the bar then defining the tensioning force with which the pockets generally are tensioned in a downward direction and thus held in shape. It will be appreciated that such a bar can also be fixed in other ways than by means of eyes.

In that respect, a particularly preferred configuration is one in which the ends of the bar are received in guides in which the bar overall is substantially vertically movable. More specifically, that makes it possible to compensate for an effective reduction in the length of the limbs of the U-shapes of the pockets, which occurs by virtue of deformation of the pockets, which cannot always be avoided when cumbersome articles are received therein, without excessive stresses occurring in the web material, although in that case the action of the fixing in the form of this tensioning arrangement is nonetheless maintained for the pockets overall.

It will be appreciated that the individual pockets can also be individually prestressed downwardly by the fixing, for example by means of elastic bands. The "bar" can also be formed from a semi-stiff material in order in approximately the course of the lower fixing points to adapt to a row of pockets when they are filled to different degrees or deformed to different extents. In addition the bar can in turn also be prestressed downwardly by elastic tensioning bands or other elastic aids such as springs or the like.

The guides for the bar ends are desirably provided with securing devices which prevent the bar ends from accidentally slipping out of the guides or being pulled out of same.

The tensioning of the pocket walls also provides that these lateral pocket walls can be caused to bear more firmly against the articles accommodated therein so that such articles cannot tilt so easily in the pockets even if their lower edge does not have sufficiently spaced-apart, defined support points.

However tilting of articles in the pockets can additionally be prevented by the provision in the pockets of a transverse portion which extends transversely between the pocket walls, more specifically in a position in which an article accommodated in the pocket can be supported against that transverse portion.

The transverse portion is preferably flexible and elastic so that it can also be easily moved away for example when inserting an article. It is also desirable if holding elements extending in the longitudinal direction are also additionally provided at the inward sides of the pockets, at least on one side, with the one end of the transverse portion being connected to such a holding element. That permits still better mobility and adaptation of the transverse portion for clearing the loading opening and for engagement with an article accommodated in the pocket. It will be appreciated that the transverse portion in its various design configurations can also be provided and embodied independently of the fact that a tension is produced in the side walls of the pocket by virtue of the lower fixing. If the transverse portion has a certain minimum stiffness (but nonetheless can be substantially stretchable and flexible), it can also to a certain degree itself perform the function of holding a loading opening open and can thus replace the function of producing the tensioning force in the lateral walls of the pockets. What is preferred however is a combination of both alternative forms, at least for the articles which easily tilt in such pockets.

A particularly preferred embodiment of the invention is one in which there is a respective holding element on each one of the two sides of the pockets in the interior thereof, wherein the transverse portion is fitted with its two ends to those holding elements so that the holding element and the transverse portions overall define an H-shape. The two ends of a limb of the H-shape are fixed to respective ones of two spaced-apart points on one side of a pocket or there pass through the wall of a pocket (for example two such holding elements of directly adjacent pockets could be connected together to form a continuous loop or they can be fixed to the frame or other parts). The transverse portion then connects the two holding elements within a pocket, which are preferably arranged in precisely mutually opposite relationship.

In addition the transverse portion is preferably arranged in displaced relationship from the centre between the two end points of the limbs of the H-shape, whereas the limbs of the H-shape themselves should be of a relatively great extent in the longitudinal direction of the pocket because that then affords a relatively great degree of mobility, for example in the upward and downward direction, for the transverse portion which is fixed to those holding elements which extend in the longitudinal direction. The holding elements and the transverse portion can in particular also be fixed releasably to the pockets.

It will be appreciated that the holding elements do not necessarily have to be arranged horizontally along the pocket walls but that they could also be arranged inclinedly and in the extreme case even vertically, although in this respect an only slightly inclined or horizontal arrangement is preferred.

BRIEF DESCRIPTION OF THE DRAWINGS

Further advantages, features and possible uses of the present invention will be apparent from the following description a preferred embodiment and the accompanying drawings in which.

Figure 1:
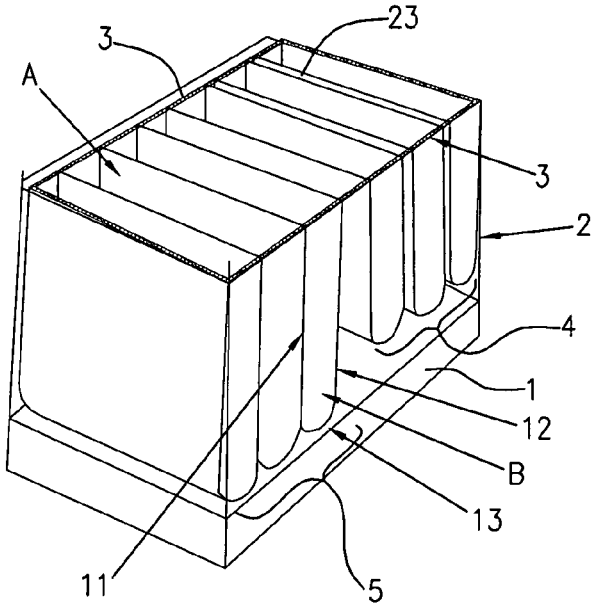
FIG. 1 PRIOR ART
FIG. 1 shows a conventional apparatus with a row of U-shaped pockets which are suspended in a support stand.

The conventional apparatus shown in FIG. 1 comprises a bottom portion 1 which is in the form of a box and frame portions 2, 3 which are fitted together or pivotably connected to each other and which define a substantially cuboidal frame on which are suspended U-shaped pockets 4, 5 which comprise a flexible web material. In this assembly, the pockets 4 are in the form of individual pockets while the pockets 5 are of an interconnected configuration so that the side wall of the one pocket at the same time also forms a side wall of an adjacent pocket. The upper edges of the pockets 4, 5 can be for example of a loop-shaped configuration, wherein bars which are not visible here extend through those loops and those pockets are arranged and selectively also fixed in guides or on frame elements 3. These individual support bars for the pockets can be for example displaceable in the longitudinal direction of the frame elements 3 but they can also be fixed, more specifically preferably in given positions, for example by means of a clamping device in a guide rail which by way of a lever jointly clamps all bar ends which are accommodated in the guides 3 and which are otherwise freely displaceable.

The individual pockets therefore comprise a left-hand limb 11 of a U-shape, in the form of a side wall of a pocket, a right-hand side wall or a right-hand limb 12 of the U-shape, and a lower transverse portion 13 which extends either horizontally or arcuately. The terms "side wall" or "limb of the U-shape" are used hereinafter synonymously for the limbs of the U-shape which are identified by references 11 and 12. The opening between the two limbs 11, 12 which is delimited downwardly by the transverse portion 13 forms a loading opening and an arrow B indicates how an article is inserted into such a pocket. It is clear in relation to the pockets 5 that the side wall 11 which is the left wall on the referenced pocket is identical to the right-hand side wall 12, in relation to the pocket 5 which is disposed in front thereof. Nonetheless it makes sense for the description to make a distinction between the left-hand and right-hand walls by referring for example to the inside surfaces of the pockets.

Figure 2:
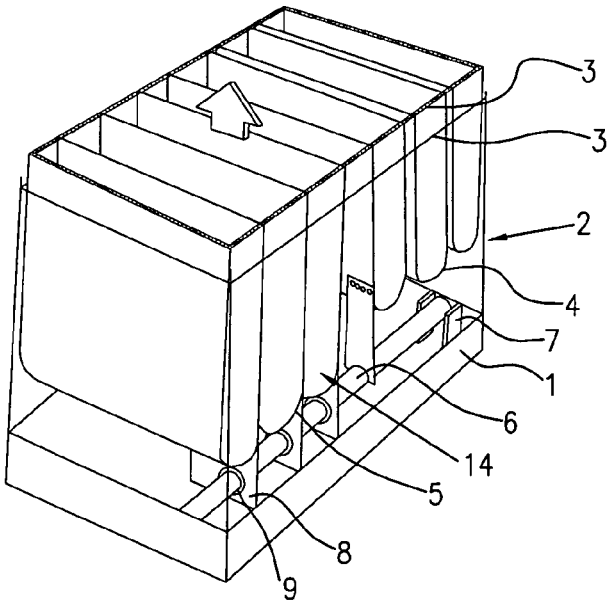
FIG. 2 shows the addition to the conventional apparatus of a tensioning arrangement according to the invention.
Figure 2A:
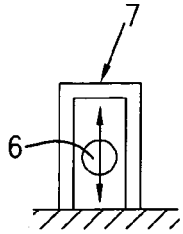
FIG. 2*a* shows a magnified cross section of a bar retaining arrangement used in the embodiment of FIG. 2.

The upper frame elements 3 however can also be removable upwardly, as indicated by an arrow C in FIG. 2, in which respect FIG. 2 additionally shows the features of the present invention, more specifically in the form of a bar 6 which extends through eyes 9 in a row of lugs or tabs 8 which in turn are sewn to the individual pockets as prolongation portions of the vertically downwardly hanging limbs of the U-shape. The ends of the bar 6 run in vertical guides 7 which are shown in somewhat greater detail in the part of the Figure which is shown separately at bottom right in FIG. 2.

The weight of the bar 6 thereby tightens the side walls 11, 12 in particular in the region of the front edges of the side walls 11, 12 and thereby holds the loading opening 14 open and at a spacing which is predetermined by the spacing of the eyes 9 on the bar 6. Optionally, the bar 6 may also have depressions or detent locations by virtue of which the positions of the eyes are fixed at least in the tensioned condition. The bar may however also have a correspondingly rough surface or a surface which adheres firmly to the material of the eyes so that the eyes cannot slip so easily. On the other hand, in many embodiments, easy displacement of the eyes may also certainly be desired, which definitely must not limit the utility of the apparatus, that nonetheless the pockets are in a well-defined fashion tensioned and held in an open condition.

It will be appreciated that a corresponding bar can also be provided on the other side of the pockets and that the tabs or flaps can also extend over the entire length of the side walls. In particular the tabs 8 can also comprise an elastic material or they can be replaced by elastic bands or strips to which corresponding eyes 9 are fixed. The use of such an elastic suspension arrangement means that it is possible to provide for better distribution of the forces which under some circumstances become unequal at the individual eyes by virtue of the fact that the pockets are loaded in different ways, that is to say they are either partially empty or they are loaded with different articles.

As can be seen in the partial view at bottom right in FIG. 2 the guides 7 are closed or closable at their top side so that the bars 6 cannot be readily lifted out upwardly but still remain vertically movable. In addition rubber bands or the like can also bias the bar 6 downwardly.

It will be appreciated that instead of being suspended on a movable bar, each pocket can also be individually fixed with elastic strips or bands to fixing points in the lower frame or housing portion 3.

FIG. 3 shows yet again another alternative form of a pocket which in this case is formed from two side walls 11', 12' which are simple, separate rectangular webs which are suspended with their two upper corners by way of eyes 15 on two bars 16. The two side walls 11', 12' are connected together by a transverse portion 13' which in turn is of a U-shaped configuration with relatively short limbs which comprise a flexible sewable material and are sewn to the side walls 11', 12' while the actual transversely extending portion of the connecting element 13 has a semi-stiff inlay and thereby defines a fixed minimum spacing between the side walls 11', 12', even if in principle the flexible side walls 11', 12' would permit a tilting movement and thus also would permit the side walls 11', 12' to move towards each other.

It is also possible to see the bar 6 in the lower region which extends there through the eyes 9 which are arranged in the lower corner region of the rectangular webs 11', 12'.

In addition, it is possible to see in this embodiment a securing element 20 in the form of elastic bands which are connected together in an H-shape. More specifically the securing element 20 comprises a transverse portion 21 and two symmetrically arranged longitudinal portions 22.

The transverse portion 21 is fixed with its two ends to the longitudinal portions 22, more specifically in markedly displaced relationship towards the end of the loading opening 14. Desirably the portions 21, 22 are produced in a continuous configuration from an elastic material such as for example a Viton band or a rubber band or cable, and the elements 21, 22 could be for example of a cross-section of some $mm^2$.

The ends of the limbs 22 of the H-shape are fixed to or passed through the side walls 11', 12' in the proximity of the front and rear edges thereof, they could for example be connected in the form of loops to corresponding holding elements or limbs 22 of H-shapes in adjacent pockets.

It is also possible to see at the rearward opening of the U-shaped pocket a further transverse or abutment portion 17 which serves as a support portion or abutment for an article to be inserted therein.

Figure 3:
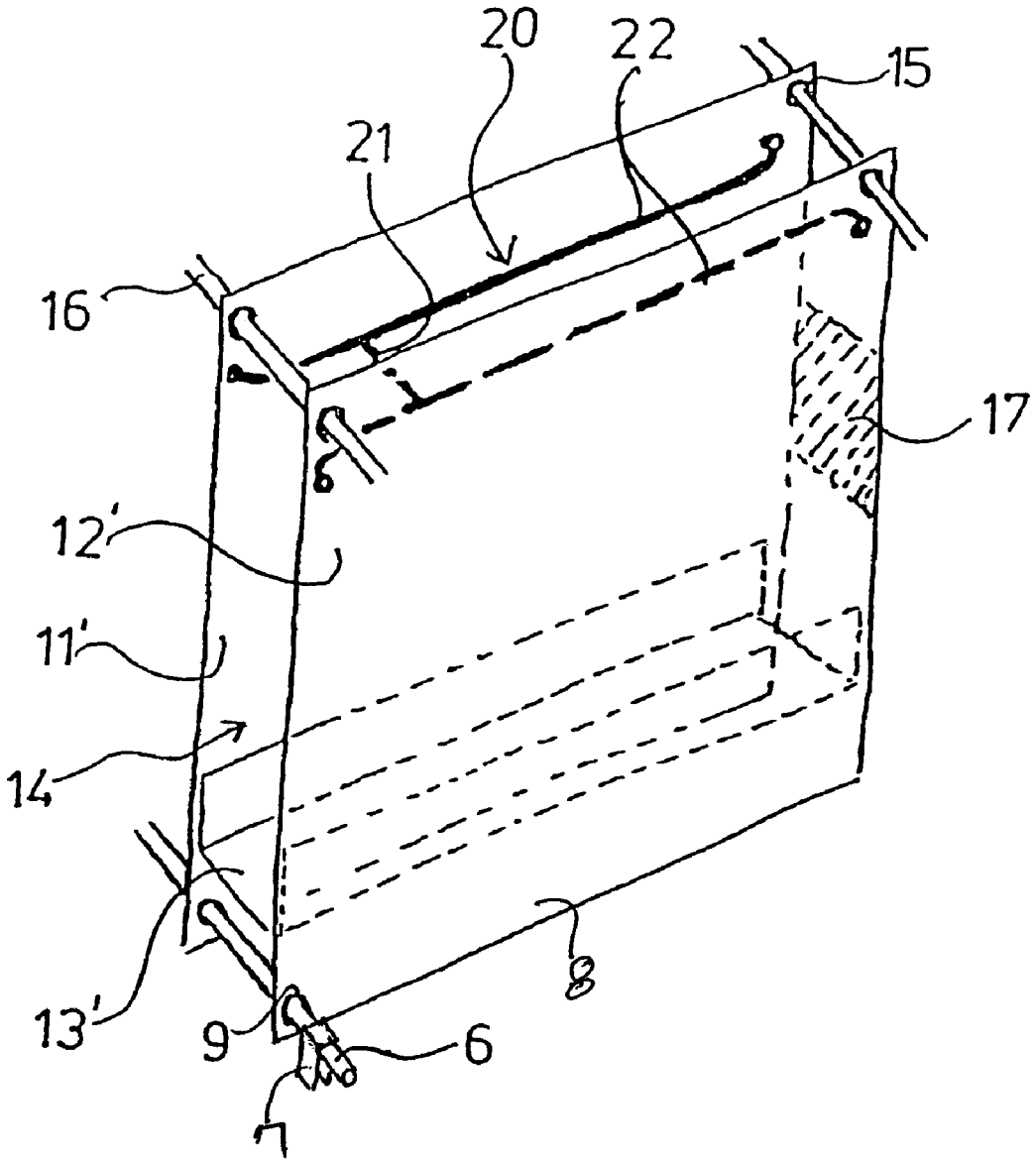
FIG. 3 is a view of a further alternative form of pocket with an additional securing element.
Figure 4:
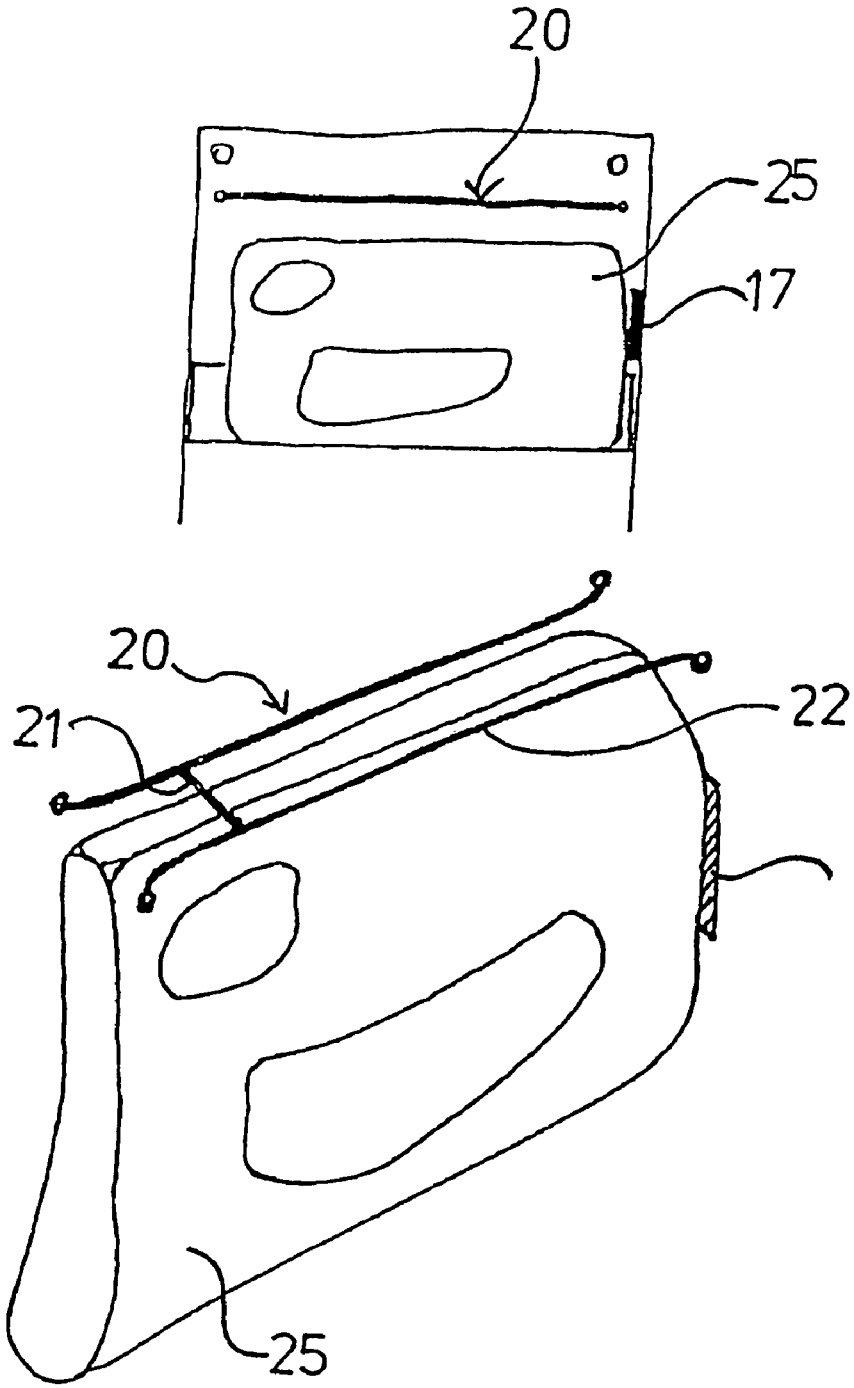
FIG. 4 shows the arrangement of the securing element in relation to an article which is accommodated in the pocket and which is tilt-proof.
Figure 5:
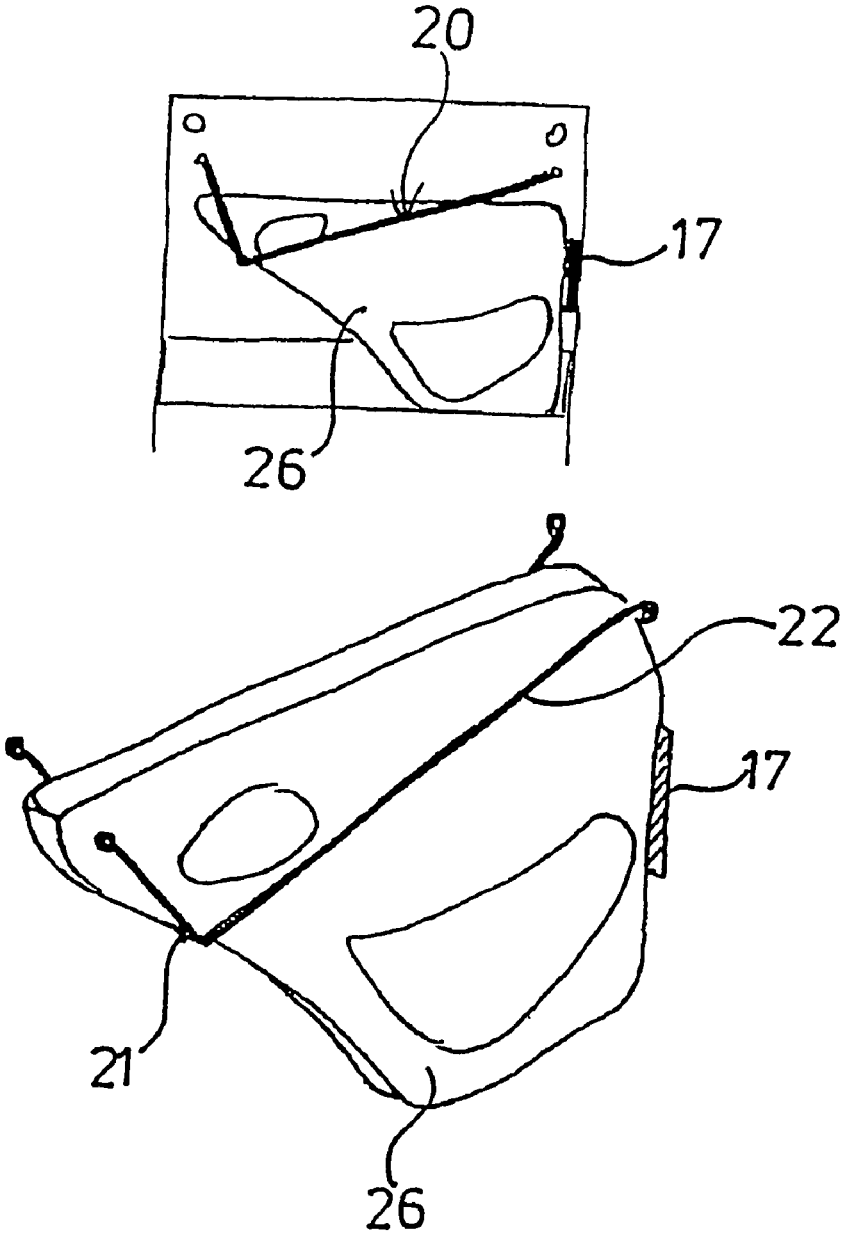
FIG. 5 shows the arrangement and use of the securing element in relation to an article which otherwise could not be tilt-proofly accommodated in the pocket.
Figure 6:
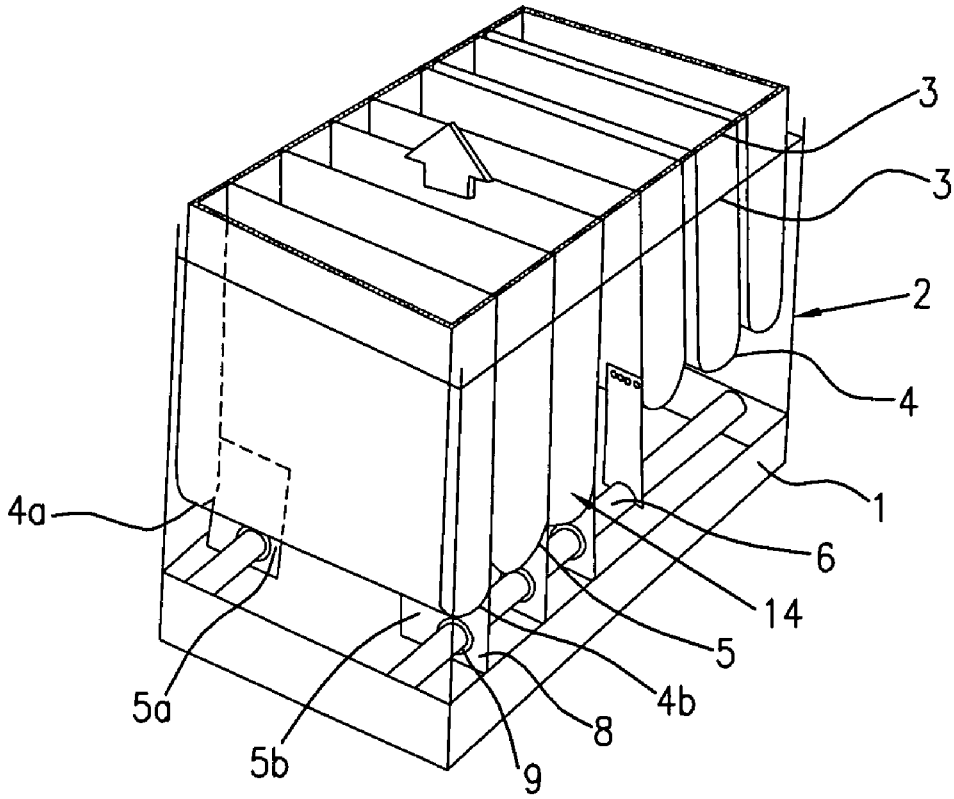
FIG. 6 shows an embodiment similar to that of FIG. 2 except that attachment in the proximity of two lower ends 4*a* and 4*b* of a U-shaped pocket are shown and the bar 6 is biased away from the bottom wall of the pocket by elastic 5*a* and 5*b* pulling downwardly on the bar 6 and also on the pockets.

FIGS. 4 and 5 diagrammatically show the possible use of the pocket employed in FIG. 3 and the securing element 20 arranged therein. In this respect, the upper part of each of FIGS. 4 and 5 only shows the pocket from the side in regard to its contour while the lower part thereof shows a perspective view of an article to be accommodated only together with the securing element 20.

The example in FIG. 4 diagrammatically shows a lateral door filling structure of a motor vehicle which is of substantially rectangular outline and which is simply inserted beneath the securing element 20 into the opening 14 of the pocket until it bears against the rearward transverse portion 17 which is also additionally shown in FIG. 4. Because of the long straight lower edge of the door cladding 25, this component is securely accommodated in the pocket without the need for any additional supports.

The example of FIG. 5 however shows another door cladding 26 which for example shows a door which is heavily cut-away in the lower region (for example in front of a wing or fender). In that case the door cladding 26 is to be transported in the pocket as far as possible in the orientation illustrated so that it is in precisely that orientation that it can be removed from the pocket and fitted directly without having to be first turned in a complicated procedure. The lower edge of this door cladding 26 however is so short that the cladding does not stand in a stable condition on the bottom of the pocket but can very easily tilt, particularly when swinging transportation movements are involved.

In this respect, the end which is shown farthest to the left in FIG. 5 could project out of the front opening of the pocket and suffer damage. In this case therefore this door cladding is firstly inserted in the same manner as was illustrated in relation to FIG. 4, that is to say until the right-hand edge of the door cladding comes to bear against the rear abutment or abutment portion 17. Then, the person who pushed the door cladding into the pocket can use a hand to grip the transverse portion, pull it forwardly over the top left corner of the door cladding 26 by virtue of the elastic nature of the holding elements 22 and engage the transverse portion 21 in position under that front corner. In that way the securing element 20 holds the door cladding 26 securely and firmly in the position illustrated in FIG. 5 without the door cladding 26 being able to slip or tilt.

The elastic holding elements at the lower edge of the U-shaped pockets are preferably mounted in such a way that upon downward movement of the upper frame portions holding the pockets, they prevent the pockets from moving out of the frame.

The invention claimed is:

1. Apparatus for storing and transporting piece good articles in U-shaped pockets having a flexible bottom and flexible lateral limb sidewalls which articles tend to distort the sidewalls and a transverse wall connecting internal surfaces of said pockets, the sidewalls being suspended in a support frame in the proximity of an upper edge of the pockets and wherein an attachment is provided for stabilizing a lower end of the pockets by providing a defined downward tensioning force sufficient to hold the pockets open during loading, wherein the attachment is mounted to the pockets (4, 5) in the proximity of a lateral loading opening (14) and wherein the attachment is in the proximity of two lower ends of a U-shaped pocket (4, 5) said apparatus further comprising openings (9) in the lateral limb sidewalls (11, 12) below the bottom and a bar (6) extending transversely through the openings in the sidewalls, wherein the weight of the bar provides a downwardly directed tensioning force upon the sidewalls (11, 12) of the pockets (4, 5).

2. Apparatus according to claim 1 wherein the means for providing a tensioning force comprises elastic pulling downwardly on the pocket.

3. Apparatus according to claim 1 wherein ends of the bar (6) are accommodated in substantially vertically extending guides (7).

4. Apparatus according to claim 1 wherein the bar (6) is biased away from the bottom wall by elastic pulling downwardly on the bar.

5. Apparatus according to claim 3 wherein the guides (7) for the bar ends (6) have a securing means to prevent the bar ends from unintentionally sliding out of the guide.

6. Apparatus according to claim 1 wherein at least one holding element (22) is provided on a sidewall (11, 12) in an interior of the pocket.

7. Apparatus according to claim 6 wherein an end of the transverse portion (21) is connected to the holding element (22).

8. Apparatus according to claim 7 wherein on both sidewalls in the interior of the pockets (4, 5) is a holding element (22) extending substantially in the transverse portion (21).

9. Apparatus according to claim 8 wherein the holding elements (22) and the transverse portion (21) substantially define an H-shape, wherein ends of limbs of the H-shape are respectively secured to a sidewall (11, 12) of the pocket (4, 5).

10. Apparatus according to claim 8 wherein the holding elements (22) and the transverse portion (21) are made in one piece from elastic material.

11. Apparatus for storing and transporting piece good articles in U-shaped pockets having a flexible bottom and flexible lateral limb sidewalls which articles tend to distort the sidewalls and a bottom connecting the sidewalls, the sidewalls being suspended in a support frame in the proximity of an upper edge of the pockets and wherein an attachment is provided for stabilizing a lower end of the pockets and wherein elastic holding elements are mounted to a lower edge of the U-shaped pockets in such a way that upon downward movement of a lower end of the pockets, the elastic holding elements provide a defined downward tensioning force that prevents the pockets from moving out of the frame.

12. Apparatus for storing and transporting piece good articles in U-shaped pockets having a flexible bottom and flexible lateral limb sidewalls which articles tend to distort the sidewalls and a bottom connecting the sidewalls, the sidewalls being suspended in a support frame in the proximity of an upper edge of the pockets and wherein at least one attachment exterior to the pockets is provided below the pockets for stabilizing a lower end of the pockets by providing a downward tensioning force where the downward tensioning force is provided by elastic pulling downwardly on the pocket.

13. Apparatus for storing and transporting piece good articles in U-shaped pockets according to claim 12 wherein downward tensioning force is sufficient to hold the pockets open during loading.

14. Apparatus according to claim 13 wherein the attachment is mounted to the pockets (4, 5) in the proximity of and below a lateral loading opening (14).

15. Apparatus according to claim 13 wherein a transverse portion (21) extends between the sidewalls.

16. Apparatus according to claim 15 wherein the transverse portion (21) is elastic.

17. Apparatus for storing and transporting piece good articles in U-shaped pockets having flexible limb sidewalls and a flexible bottom connecting the sidewalls, which articles tend to distort the sidewalls and the bottom, the sidewalls being suspended in a support frame in the proximity of an upper edge of the pockets, the upper elements of said support frame being removable, the pockets additionally being fixed to non-removable lower elements of the support frame in a region near or below the bottom wall.

* * * * *